United States Patent [19]
Krautwald
[11] 4,198,008
[45] Apr. 15, 1980

[54] REINFORCING SLEEVE FOR THE ENDS OF REEL CORES

[75] Inventor: Walter Krautwald, Bad Brückenau, Fed. Rep. of Germany

[73] Assignee: Firma Paul & Co. Inh. K. Kunert & Sohne, Fed. Rep. of Germany

[21] Appl. No.: 6,727

[22] Filed: Jan. 26, 1979

[30] Foreign Application Priority Data

Feb. 17, 1978 [DE] Fed. Rep. of Germany ... 7804704[U]

[51] Int. Cl.² ..... B65H 17/02
[52] U.S. Cl. ..... 242/68.6
[58] Field of Search ..... 242/68.6, 118.31

[56] References Cited

U.S. PATENT DOCUMENTS

| | | | |
|---|---|---|---|
| 411,140 | 9/1889 | Farrington | 242/68.6 |
| 1,494,440 | 5/1924 | Parker | 242/68.6 |
| 1,812,421 | 6/1931 | Wickware | 242/68.6 |
| 2,760,732 | 8/1956 | Bebie | 242/68.6 |

FOREIGN PATENT DOCUMENTS

| | | | |
|---|---|---|---|
| 464668 | 8/1928 | Fed. Rep. of Germany | 242/68.6 |

*Primary Examiner*—Edward J. McCarthy
*Attorney, Agent, or Firm*—Jacobi, Lilling & Siegel

[57] ABSTRACT

A reinforcing sleeve of plastic or a similar material for the ends of hard paper reel cores or the like which form the support cores for wound goods such as paper, foils, textiles or the like. The sleeve comprises a collar adapted to rest against the end faces of the reel core and a radial, hollow projection integrated with the collar and the outer periphery of the sleeve, the projection being adapted to engage one end face of the reel core and to house a driver system. A reinforcing ring is integrated in the collar and comprises a radially extending receiving element for the driver system, the receiving element being integrated in the radial projection and reinforcing it.

4 Claims, 4 Drawing Figures

REINFORCING SLEEVE FOR THE ENDS OF REEL CORES

BACKGROUND OF THE INVENTION

The present invention relates to a reinforcing sleeve made of plastic or the like for the ends of hard-paper reel cores or the like, which form the support cores for wound materials such as paper, foils, textiles, etc., comprising a collar to be placed against one of the end faces of the hard-paper reel core, and a radial hollow projection for seating a driver means, said projection being located at the outer periphery of the reinforcing sleeve and at the collar.

Such a reinforcing sleeve is known from German Gebrauchsmuster Pat. No. 77 21 797. This sleeve serves to reinforce reel cores made of hard paper or similar materials at their ends that are compatible with the so-called spindleless tensioning systems. It must be considered in this respect that in the case of sudden immobilization of equipment, heavy reels—the weights of which may be a ton or more for each—are slowed down by means of their axles, so that the ends of the hard-paper reel cores resting on the two spindles of the tensioning system are subjected to substantial loads. Provided the braking cams of the tensioning equipment are at a normal height between 8 and 12 mm, the above-discussed reinforcing sleeves satisfactorily fill their roles. If, on the other hand, braking cams are used in such tensioning equipment with the height or radial size—determined by the previous sleeves—being appreciably less and amounting only to about 3 mm, then there is the danger that when slowing down heavy reels, the braking cams will pierce the reinforcing sleeves by their spindles.

The present invention, therefore, addresses the problem of remedying the above drawback while retaining the great advantages of such reinforcing sleeves, so that they can fill the intended function satisfactorily when used with tensioning equipment of which the braking cams or drivers are only of slight elevation or radial size, such as is adequate for steel reel cores.

SUMMARY OF THE INVENTION

According to the present invention, this problem is solved for a reinforcing sleeve of the initially discussed type by integrating a reinforcing ring, for instance of metal, into the collar, the ring comprising an axially projecting seating element for the driver system, the element being incorporated in the radial projection and reinforcing it. Such a reinforcing ring may be a simple machined or cast part to which the receiver element, for instance, is welded or formed integrally therewith. Preferably, the reinforcing ring including its receiving element is made of steel, even though extremely hard plastic or another material with steel-like properties also may be used. The incorporation of the reinforcing ring together with its receiving element for the drive system advantageously is accomplished when shaping or injection-molding the plastic reinforcing sleeve. Braking cams or drivers of tensioning equipment of only slight elevation or radial dimensions of a few mm, are sufficiently supported in the reinforcing receiving element preferably made of steel so that even high reel weights can be reliably slowed down by means of the paperboard reel cores and the ends of the plastic reinforcing sleeves. Advantageously, the substantial braking forces acting on the receiving element for the brake cams or drivers are essentially uniformly distributed in transmission over the periphery of the plastic reinforcing sleeve. It is precisely furthermore by this characteristic that the reliability of the plastic reinforcing sleeves is appreciably enhanced during braking processes.

According to one embodiment of the invention, the reinforcing ring may comprise a clearance extending radially outwardly from its inside peripheral rim, and the receiving element may comprise a radially inward cavity that opens opposite the clearance, the cross-sections of the cavity and clearance substantially corresponding to each other. The braking cam or driver of a tensioning system thereby may advantageously engage both the receiving element and the reinforcing ring at the same time.

According to another embodiment of the innovation, the reinforcing ring is connected with the reinforcing sleeve by several retaining studs located in countersunk bores in it, and forms essentially the outer end face of the collar, and the inside rims of the reinforcing ring and of the receiving element are substantially flush with the inside diameter of the reinforcing sleeve, and lastly the outer peripheral rim of the reinforcing ring is surrounded by part of the collar of the reinforcing sleeve. In such a construction, the further advantages are obtained. Because the reinforcing ring is enclosed by a relatively thin layer, the outer diameter of the collar of the reinforcing sleeve, which must agree with that of the hard paper reel core, can be precisely controlled, and this in a simple manner. An injection molding process is simplified in the case of a plastic sleeve because the reinforcing ring together with its receiving element is simply inserted into the injection mold and then plastic is injected around it, this plastic then penetrating through the countersunk bores in the reinforcing ring and reliably connecting it with the plastic reinforcing sleeve.

DESCRIPTION OF THE PREFERRED EMBODIMENTS

Figure 1:
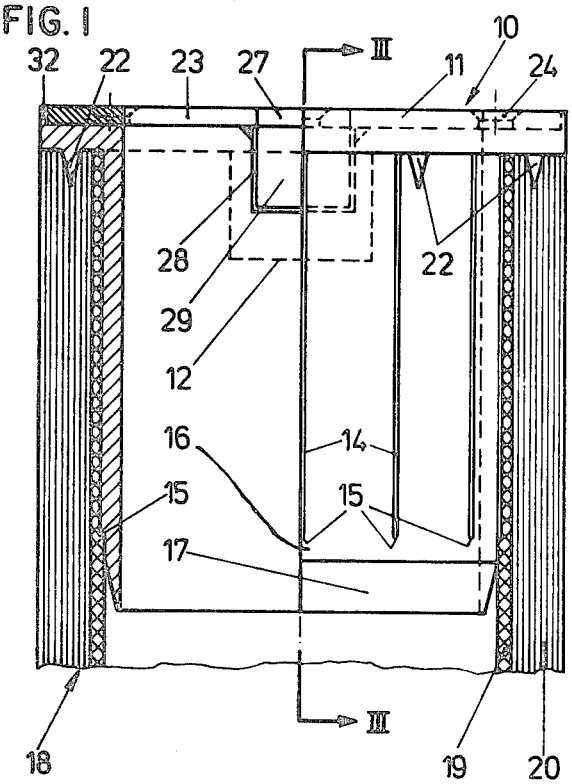
FIG. 1 is a side elevational view, with parts broken away, of a reinforcing sleeve of the present invention, shown partly in section along line 1—1 of FIG. 2, and also shown connected with part of the hard paper reel core which also is shown in section.

Referring to FIG. 1, the reinforcing sleeve 10, preferably formed of plastic or another suitable material, is provided at one end with a collar 11 and with a radial projection 12 integrated with the collar 11 and the outer periphery of the plastic reinforcing sleeve 10. The purpose of this radial projection 12 is explained further hereinafter.

Numerous drive ribs 14, uniformly spaced in the circumferential direction and disposed substantially parallel to the spindle are integrated with the outer circumference of the reinforcing sleeve 10, the ribs preferably being triangular in cross-section. Those ends of drive ribs 14 away from collar 11 are pointed and provided with a cutting edge 15 extending substantially perpendicularly to the axis of the reinforcing sleeve 10. The cutting edge ends of drive ribs 14 are disposed adjacent to a smooth, cylindrical guide segment 16 of the reinforcing sleeve 10, the segment being followed by a terminal, conical, inwardly tapering segment 17 which facilitates the introduction of the reinforcing sleeves into the ends of a hard paper reel core 18 which may form the support for various types of wound goods. The hard paper reel core 18 is shown as comprising two laminations 19 and 20 of different hardnesses, lamination 19 being the harder one.

The outer diameter of the reinforcing sleeve 10 at the guide segment 16 or between the drive ribs 14 corresponds to the inside diameter of the hard paper reel core 18, whereas the outside diameter of the collar 11 equals that of the core, in order to achieve smooth passage between the collar 11 and core 18. Each end face of the hard paper reel core 18 is provided with a suitable clearance 21 to seat in close-fitting manner the projection 12 acting as drive means, as shown in FIG. 3.

Collar 11 on its inside comprises, for instance, four integral drive pins 22. The guide segment 16 is used to align the reinforcing sleeve with the reel core axis when the sleeve is placed into an end of the hard paper reel core. When the reinforcing sleeve is driven into the hard paper reel core, the drive ribs 14 pierce the inside of the hard paper reel core and, toward the end of this penetration process, the drive pins 22 pierce into the particular end face of the hard paper reel core until collar 11 rests fully on the end face. The precise alignment so obtained between the axis of the reinforcing sleeve and the axis of the reel core ensures proper rotation of the hard paper reel core when used as the support for wound wares of diverse types.

Figure 2:
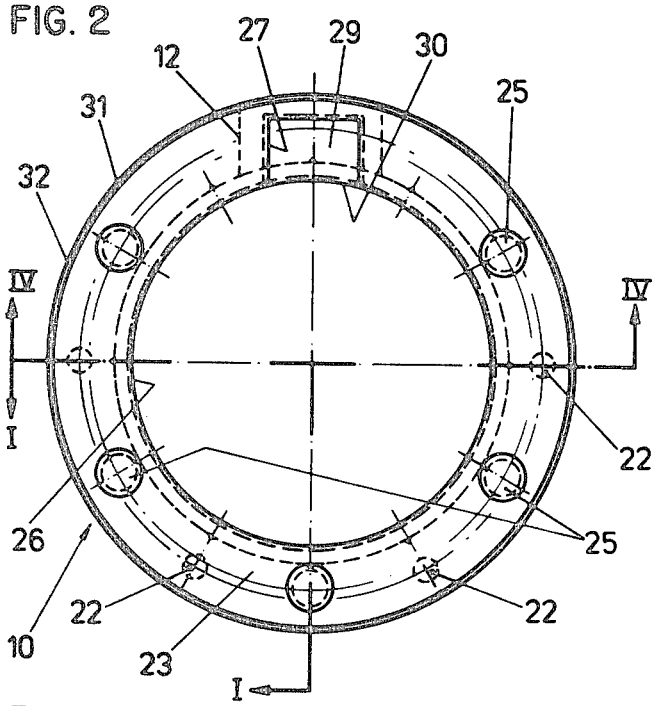
FIG. 2 is a front elevational view of the reinforcing sleeve, showing the reinforcing ring.
Figure 4:
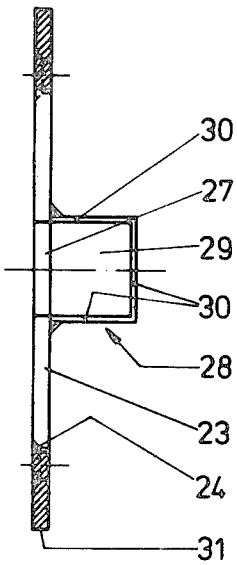
FIG. 4 is a sectional view of the reinforcing ring with its receiving element for the driver system, taken substantially along line IV—IV of FIG. 2.
Figure 3:
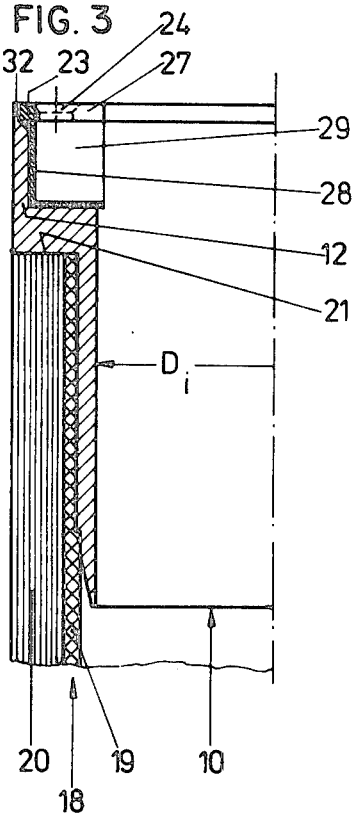
FIG. 3 is a partial sectional view of the reinforcing sleeve, taken substantially along line III—III of FIG. 1.

As shown in FIGS. 1 and 3, a reinforcing ring 23, made for instance of steel or another suitable material, is compactly integrated by its outer end face into collar 11. This reinforcing ring 23 comprises several countersunk bores 24 into which retaining studs 25 (FIG. 2) are formed during the injection-molding of a reinforcing sleeve 10, the studs serving to secure the reinforcing ring with the sleeve against rotation.

Reinforcing ring 23 furthermore comprises a rectangular clearance 27 extending radially outwardly from its inside peripheral rim 26. Opposite the clearance, there is a box-like receiving element 28 for the braking cam or driver of a tensioning system (not shown) mounted on reinforcing ring 23, e.g., welded to it or formed integral with it in some other manner. Receiving element 28 comprises an inwardly radial cavity 29 (FIGS. 1-4) which is open opposite clearance 27 and allows penetration of the braking cam or driver, its cross-section corresponding to that of clearance 27.

Receiving element 28 is integrated into radial projection 12 of the reinforcing sleeve 10 to reinforce the latter. The inside peripheral rim 26 of the reinforcing ring 23 and the inside rims 30 of the receiving element 28 are flush with the inside diameter $D_i$ of the reinforcing sleeve 10. The outer peripheral rim 31 of the reinforcing ring 23 is enclosed by a part 32 of collar 11.

What is claimed is:

1. In a reinforcing sleeve formed of plastic or the like for the ends of hard paper reel cores or the like forming the support cores for wound goods such as paper, foils, textiles etc., the sleeve comprising a collar adapted to rest against the end faces of the reel core and a radial, hollow projection integrated with the collar and the outer periphery of the reinforcing sleeve, the projection being adapted to engage one end face of the reel core and to house a driver system, the improvement wherein:

a reinforcing ring (23) is integrated in collar (11) and comprises a radially extending receiving element (28) for the driver system, said receiving element being integrated in said radial projection (12) and reinforcing it.

2. The reinforcing sleeve of claim 1, characterized in that said reinforcing ring (23) comprises a clearance (27) extending radially outward from its inside peripheral rim (26), and in that the receiving element (28) comprises a cavity (29) opening radially inwardly opposite clearance (27), the crosssections of said cavity and said clearance substantially corresponding to each other.

3. The reinforcing sleeve of claims 1 or 2, characterized in that said reinforcing ring (23) is connected by several retaining studs (25) shaped in its countersunk bores (24) with said reinforcing sleeve (10) and forms the outer end face of said collar (11), in that the inside rims (26, 30) of said reinforcing ring (23) and said receiving element (28) are substantially flush with the inside diameter of said reinforcing sleeve (10), and in that the outer peripheral rim (31) of said reinforcing ring (23) is enclosed by a part (32) of collar (11) of said reinforcing sleeve (10).

4. The reinforcing sleeve of claim 3 wherein the sleeve is formed of plastic and said reinforcing ring (23) is formed of metal.

* * * * *